US011204189B2

(12) United States Patent
Sharar et al.

(10) Patent No.: US 11,204,189 B2
(45) Date of Patent: Dec. 21, 2021

(54) CONTINUOUS BENDING-MODE ELASTOCALORIC COOLING/HEATING FLOW LOOP

(71) Applicant: Department of the Army, U.S. Army CCDC Army Research Laboratory, Adelphi, MD (US)

(72) Inventors: Darin J. Sharar, Silver Spring, MD (US); Brendan M. Hanrahan, Silver Spring, MD (US)

(73) Assignee: The United States of America as represented by the Secretary of the Army, Washington, DC (US)

( * ) Notice: Subject to any disclaimer, the term of this patent is extended or adjusted under 35 U.S.C. 154(b) by 65 days.

(21) Appl. No.: 16/459,667

(22) Filed: Jul. 2, 2019

(65) Prior Publication Data

US 2020/0088449 A1 Mar. 19, 2020

Related U.S. Application Data

(60) Provisional application No. 62/732,354, filed on Sep. 17, 2018.

(51) Int. Cl.
*F25B 23/00* (2006.01)

(52) U.S. Cl.
CPC ..... *F25B 23/00* (2013.01)

(58) Field of Classification Search
CPC ..... F25B 23/00
See application file for complete search history.

(56) References Cited

U.S. PATENT DOCUMENTS 5,339,653 A * 8/1994 DeGregoria ..... A62B 9/003 165/10
6,367,281 B1 4/2002 Hugenroth
2012/0273158 A1 11/2012 Cui et al.
(Continued)

FOREIGN PATENT DOCUMENTS

WO WO02084185 A1 10/2002

OTHER PUBLICATIONS

Krevet, B., et al., "Evolution of temperature profiles during stress-induced transformation in NiTi thin films," Materials Science Forum, vols. 738-739, pp. 287-291, Jan. 25, 2013.
(Continued)

*Primary Examiner* — Brian M King
(74) *Attorney, Agent, or Firm* — Eric B. Compton

(57) ABSTRACT

A method of cooling includes providing an elastocaloric material; continuously applying a force on the elastocaloric material to cause a continuous mechanical deformation of the elastocaloric material for a predetermined period of time, such that the continuous mechanical deformation creates a solid-to-solid phase transformation in the elastocaloric material; emitting exothermic latent heat from the elastocaloric material to increase a temperature of the elastocaloric material; removing the force from the elastocaloric material upon expiration of the predetermined period of time; and absorbing endothermic latent heat into the elastocaloric material to decrease the temperature of the elastocaloric material and/or an environment adjacent to the elastocaloric material or an electronic/phononic device, etc.

25 Claims, 10 Drawing Sheets

(56) References Cited

U.S. PATENT DOCUMENTS

2017/0138648 A1* 5/2017 Cui ..... C09K 5/14

OTHER PUBLICATIONS

Ahadi, A., et al., "Stress-induced nanoscale phase transition in superelastic NiTi by in situ X-ray diffraction," Acta Materialia, vol. 90, pp. 272-281, Mar. 16, 2015.

Cui, J., et al., "Combinatorial search of thermoelastic shape-memory alloys with extremely small hysteresis width," Nature Materials, vol. 5, pp. 286-290, Mar. 5, 2006.

Qian, S., et al., "Dynamic performance of a compression thermoelastic cooling air-conditioner under cyclic operation mode," in 15th International Refrigeration and Air Conditioning Conference, Paper 1411, pp. 1-10, Jul. 14-17, 2014.

Qian, S., et al., "Thermodynamics cycle analysis and numerical modeling of thermoelastic cooling systems," International Journal of Refrigeration, vol. 56, pp. 65-80, Apr. 14, 2015.

Engelbrecht, K., et al., "A regenerative elastocaloric device: experimental results," Journal of Physics D: Applied Physics, vol. 50, pp. 1-7, Sep. 27, 2017.

Qian, S., et al., "Performance enhancement of a compressive thermoelastic cooling system using multi-objective optimization and novel designs," International Journal of Refrigeration, vol. 57, pp. 62-76, May 1, 2015.

Schmidt, M., et al., "Thermal stabilization of NiTiCuV shape memory alloys: Observations during elastocaloric training," Shape Memory and Superelasticity, vol. 1, No. 2, pp. 132-141, Jun. 20, 2015.

Qian, S., et al., "Design, development and testing of a compressive thermoelastic cooling prototype," in 24th International Congress of Refrigeration (ICR2015), Paper No. 0092, pp. 1-8, Yokohama, 2015.

Berg, B., et al., "Bending of superelastic wires, Part I: experimental aspects," ASME Journal of Applied Mechanics, vol. 62, pp. 459-465, Jun. 1995.

Berg, B., et al., "Bending of superelastic wires, Part II: application to three-point bending," ASME Journal of Applied Mechanics, vol. 62, pp. 466-470, Jun. 1995.

Rejzner, J., et al., "Pseudoelastic behaviour of shape memory alloy beams under pure bending: experiments and modelling," International Journal of Mechancal Science, vol. 44, No. 4, pp. 665-686, 2002.

Reedlunn, B., et al., "Tension, compression, and bending of superelastic shape memory alloy tubes," Journal of the Mechanics and Physics of Solids, vol. 63, pp. 506-537, Jan. 23, 2013.

Goetzler, W., et al., "Energy savings potential and RD&D opportunities for non-vapor-compression HVAC technologies," U.S. Department of Energy Building Technologies Office (BTO), DOE/EE-1021, 199 pages, Mar. 2014.

Parham Kabirifar, et al., "Elastocaloric Cooling: State-of-the-art and Future Challenges in Designing Regenerative Elastocaloric," Journal of Mechanical Engineering 65(2019)11-12, 615-630.

D. J. Sharar, et al., "First Demonstration of a Bending-Mode Elastocaloric Cooling 'Loop'," 2018 17th IEEE Intersociety Conference on Thermal and Thermomechanical Phenomena in Electronic Systems (ITherm), May 29-Jun. 1, 2018, pp. 218-226.

Darin J. Sharar, et al., "Low-force elastocaloric refrigeration via bending," Appl. Phys. Lett. 118, 184103 (2021).

* cited by examiner

CONTINUOUS BENDING-MODE ELASTOCALORIC COOLING/HEATING FLOW LOOP

CROSS-REFERENCE TO RELATED APPLICATION(S)

This application claims the benefit of U.S. Provisional Patent Application No. 62/732,354 filed on Sep. 17, 2018, which is incorporated herein by reference in its entirety.

GOVERNMENT INTEREST

The embodiments herein may be manufactured, used, and/or licensed by or for the United States Government without the payment of royalties thereon.

BACKGROUND

Technical Field

The embodiments herein generally relate to cooling systems, and more particularly to elastocaloric cooling systems.

Description of the Related Art

Hydrofluorocarbon (HFC) refrigerants used in vapor-compression systems contribute to the depletion of the ozone layer and have limited efficiency (Coefficient of Performance (COP)=3). To limit climate change, legislation has been proposed in the United States, as well as Canada, Mexico, and the European Union, to phase out HFCs. Alternatives to the nearly ubiquitous HCF systems are being aggressively pursued including magnetocalorics, electrocalorics, and elastocalorics (eCs). Elastocalorics, which exchange mechanical and thermal energy via structural entropy changes, offer a promising alternative to vapor-compression systems with theoretical and observed COPs greater than 10. Elastocalorics also offer advantages in size and noise, in addition to the environmental benefits from the elimination of HFC refrigerants.

Elastocaloric cooling has received a groundswell of interest in recent years. Most of these studies, both experimental and theoretical, have focused on material alloy development/testing and thermodynamic cooling cycles. The conventional eCs demonstrations have relied on uniaxial strain, tension or compression, which often requires high loads and displacements.

SUMMARY

In view of the foregoing, an embodiment herein provides a method of cooling comprising providing an elastocaloric material; continuously applying a force on the elastocaloric material to cause a continuous mechanical deformation of the elastocaloric material for a predetermined period of time, wherein the continuous mechanical deformation creates a solid-to-solid phase transformation in the elastocaloric material; emitting exothermic latent heat from the elastocaloric material to increase a temperature of the elastocaloric material; removing the force from the elastocaloric material upon expiration of the predetermined period of time; and absorbing endothermic latent heat into the elastocaloric material to decrease the temperature of the elastocaloric material.

The solid-to-solid phase transformation in the elastocaloric material may comprise a first-order austenite crystal to martensite crystal phase transformation. The absorbing of the endothermic heat into the elastocaloric material may decrease the temperature of an environment adjacent to the elastocaloric material. The mechanical deformation may comprise bending. The mechanical deformation may comprise a continuous loop or flow loop. The method may comprise causing the continuous mechanical deformation to occur until reaching a mechanical strain of approximately 6% for the elastocaloric material. The absorbing of the endothermic latent heat into the elastocaloric material may decrease the temperature of the elastocaloric material to below a temperature of an adjacent ambient environment of the elastocaloric material. The temperature of the elastocaloric material may decrease by at least 1.85° C. compared with the adjacent ambient environment.

Another embodiment provides an elastocaloric cooling system comprising an elastocaloric material; a heat exchanger comprising a defined radius of curvature; and a motor to drive the elastocaloric material around the heat exchanger causing continuous bending of the elastocaloric material according to the defined radius of curvature for a predetermined period of time creating a first phase transformation in the elastocaloric material, wherein the heat exchanger is to transfer exothermic latent heat emitted from the elastocaloric material due to the first phase transformation during the predetermined period of time, and wherein the heat exchanger is to transfer endothermic latent heat from an ambient environment adjacent to the elastocaloric material after the predetermined period of time ends and the elastocaloric material is no longer experiencing bending. The elastocaloric material may comprise any of nitinol-based, copper-based, polymer-based, and magnetic shape memory materials. The endothermic latent heat transfer may cause a temperature decrease of the elastocaloric material. The temperature decrease may be in a range of 1.85° C. to 16° C. The elastocaloric material may undergo a second phase transformation when the elastocaloric material is no longer experiencing bending. The bending may comprise three-point bending, four-point bending, buckling, edge-bending, and v-bending. The predetermined period of time may comprise approximately 60 seconds.

Another embodiment provides a heat-exchanger system comprising a thermoelastic material; and a mechanism to generate a stress on the thermoelastic material to cause a continuous bending of the thermoelastic material for a predetermined period of time to create a solid-to-solid phase transformation in the thermoelastic material, wherein a first phase transformation causes exothermic heat transfer from the thermoelastic material while stress is generated, and wherein a second phase transformation causes endothermic heat transfer to the thermoelastic material after the stress is decreased. The thermoelastic material may comprise elastocaloric crystals that undergo an austenite crystal to martensite crystal transformation during the first phase transformation. The thermoelastic material may comprise elastocaloric crystals that undergo a martensite crystal to austenite crystal transformation during the second phase transformation. The mechanism may comprise a stepper motor. The first phase transformation may comprise a first strain rate. The second phase transformation may comprise a second strain rate. The first strain rate may be symmetric to the second strain rate.

These and other aspects of the embodiments herein will be better appreciated and understood when considered in conjunction with the following description and the accompanying drawings. It should be understood, however, that the following descriptions, while indicating exemplary embodiments and numerous specific details thereof, are given by way of illustration and not of limitation. Many changes and modifications may be made within the scope of the embodiments herein without departing from the spirit thereof, and the embodiments herein include all such modifications.

BRIEF DESCRIPTION OF THE DRAWINGS

The embodiments herein will be better understood from the following detailed description with reference to the drawings, in which.

DETAILED DESCRIPTION

Figure 1:
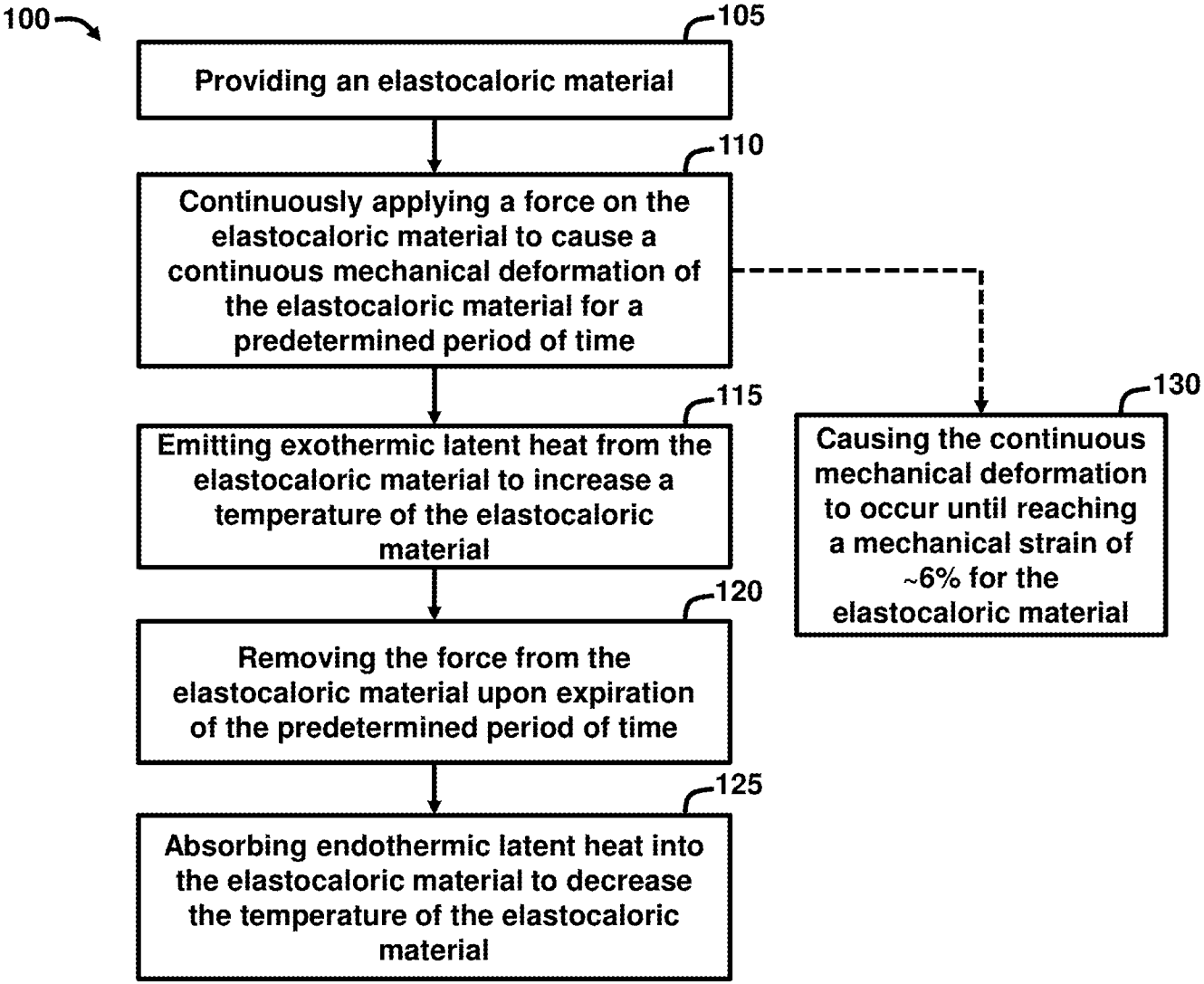
FIG. 1 is a flow diagram illustrating a method of cooling, according to an embodiment herein.

The embodiments herein and the various features and advantageous details thereof are explained more fully with reference to the non-limiting embodiments that are illustrated in the accompanying drawings and detailed in the following description. Descriptions of well-known components and processing techniques are omitted so as to not unnecessarily obscure the embodiments herein. The examples used herein are intended merely to facilitate an understanding of ways in which the embodiments herein may be practiced and to further enable those of skill in the art to practice the embodiments herein. Accordingly, the examples should not be construed as limiting the scope of the embodiments herein.

The embodiments herein provide a solid-state elastocaloric cooling technique in a continuous 'flow loop' configuration. Referring now to the drawings, and more particularly to FIGS. 1 through 9, where similar reference characters denote corresponding features consistently throughout the figures, there are shown preferred embodiments. In the drawings, the size and relative sizes of components, layers, and regions, etc. may be exaggerated for clarity.

FIG. 1 is a flow diagram illustrating a method 100 of cooling comprising providing (105) an elastocaloric material; continuously applying (110) a force on the elastocaloric material to cause a continuous mechanical deformation of the elastocaloric material for a predetermined period of time, wherein the continuous mechanical deformation creates a solid-to-solid phase transformation in the elastocaloric material; emitting (115) exothermic latent heat from the elastocaloric material to increase a temperature of the elastocaloric material; removing (120) the force from the elastocaloric material upon expiration of the predetermined period of time; and absorbing (125) endothermic latent heat into the elastocaloric material to decrease the temperature of the elastocaloric material. As used herein, the elastocaloric material is a material that releases and absorbs energy when an external force is applied causing a stress in the material.

The solid-to-solid phase transformation in the elastocaloric material may comprise a first-order austenite crystal to martensite crystal phase transformation (or an intermediate R-phase transformation). The absorbing of the endothermic heat into the elastocaloric material may decrease the temperature of an environment adjacent to the elastocaloric material or an electronic/phononic device, etc. The mechanical deformation may comprise bending. The mechanical deformation may comprise a continuous loop or flow loop. In an example, the method 100 may comprise causing (130) the continuous mechanical deformation to occur until reaching a mechanical strain of approximately 6% for the elastocaloric material, although other strain percentages are possible depending on the specific alloy or elastocaloric material being used.

The absorbing of the endothermic latent heat into the elastocaloric material may decrease the temperature of the elastocaloric material to below a temperature of an adjacent ambient environment of the elastocaloric material. The temperature of the elastocaloric material may decrease by at least 1.85° C. compared with the adjacent ambient environment, although other temperature values are possible.

Elastocaloric Cooling—Phase Transformation

Figure 2B:
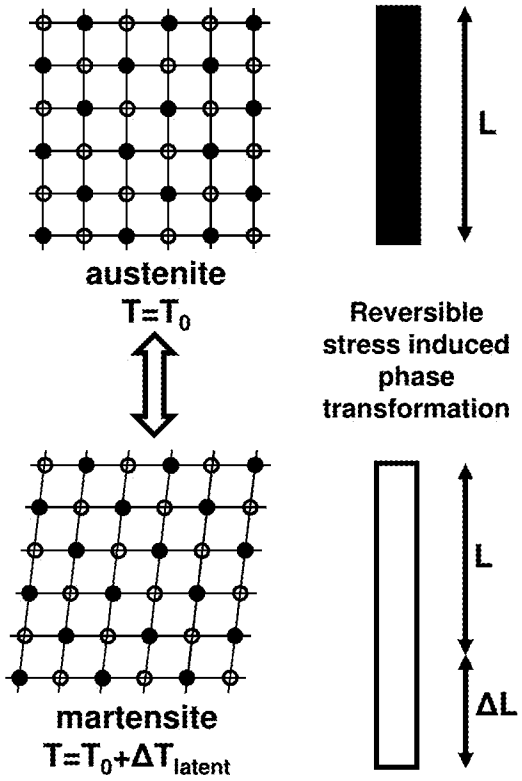
FIG. 2B is a schematic illustration of a phase change process, according to an embodiment herein.
Figure 2A:
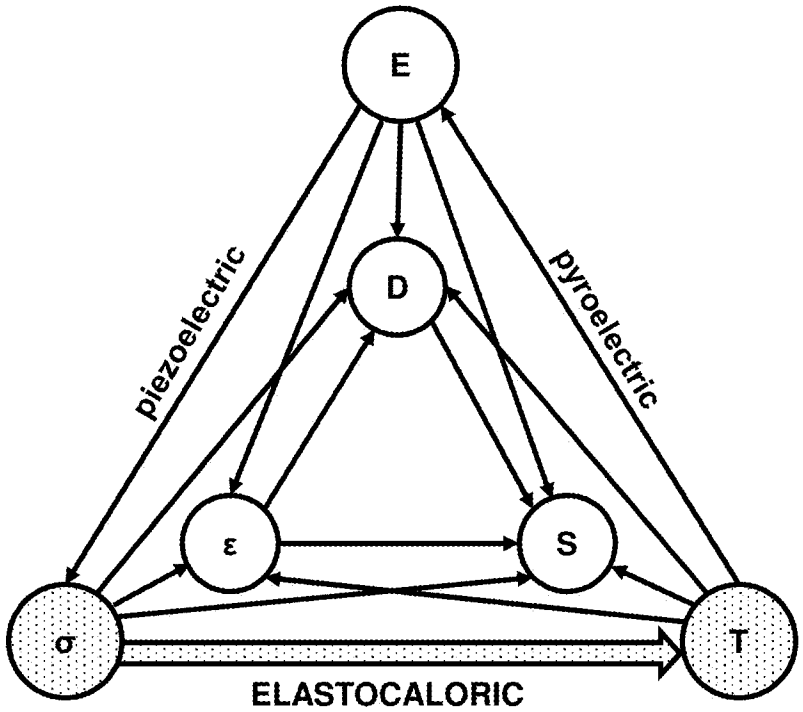
FIG. 2A is a schematic of a Heckmann diagram representing fields, responses, and cross-domain interactions, according to an embodiment herein.

Heckmann's Diagram explicitly describes the physical effects in crystals involving conversions among mechanical, thermal, and electrical energies (see FIG. 2A). The eC effect (also referred to as flexocaloric and thermoelastic) in shape memory alloys (SMAs) is the result of latent heat transfer during the stress-induced, diffusionless first-order austenite to martensite solid-to-solid phase transformation. As shown in FIG. 2B, when an external stress is applied to an eC SMA, austenite crystal transforms to martensite crystal, the material elongates, and latent heat is released to raise the materials temperature (or the temperature of the environment). As the stress is decreased, the material transforms back to austenite or 'parent' phase, the material contracts, and latent heat is absorbed to reduce the temperature of the material or the environment. This stress-induced caloric effect is observable in uniaxial tension, as well as uniaxial compression, and bending.

The maximum temperature change during the exothermic austenite to martensite and endothermic reverse transformation depends on the latent heat of transformation and the materials specific heat capacity. With knowledge of the heat capacity, and a direct measurement of the temperature change under adiabatic conditions, the latent heat of the material (for example, Nitinol (NiTi)) can be experimentally determined using the following Equation (1):

$$L_{endothermic}=\Delta T_{adiabatic}\times C_{p\ NiTi} \quad (1)$$

where $L_{endothermic}$ is the endothermic latent heat (J/g), $\Delta T_{adiabatic}$ is the adiabatic temperature change (K or ° C.), and $C_{p\ NiTi}$ is the specific heat capacity of Nitinol, for example, (0.46 J/g-K). Large endothermic latent heat values are desirable, whereby large latent heat implies large cooling potential (ΔT). Endothermic latent heat values for NiTi are typically in the range of 7 to 32 J/g and depend strongly on impurities, grain size, and stoichiometry. The maximum reported endothermic latent heat reported to date is for the ternary alloy, NiTiHf, with a value of 35.1 J/g.

Stress-Strain Characteristics, COP, and Cooling Power

Figure 2C:
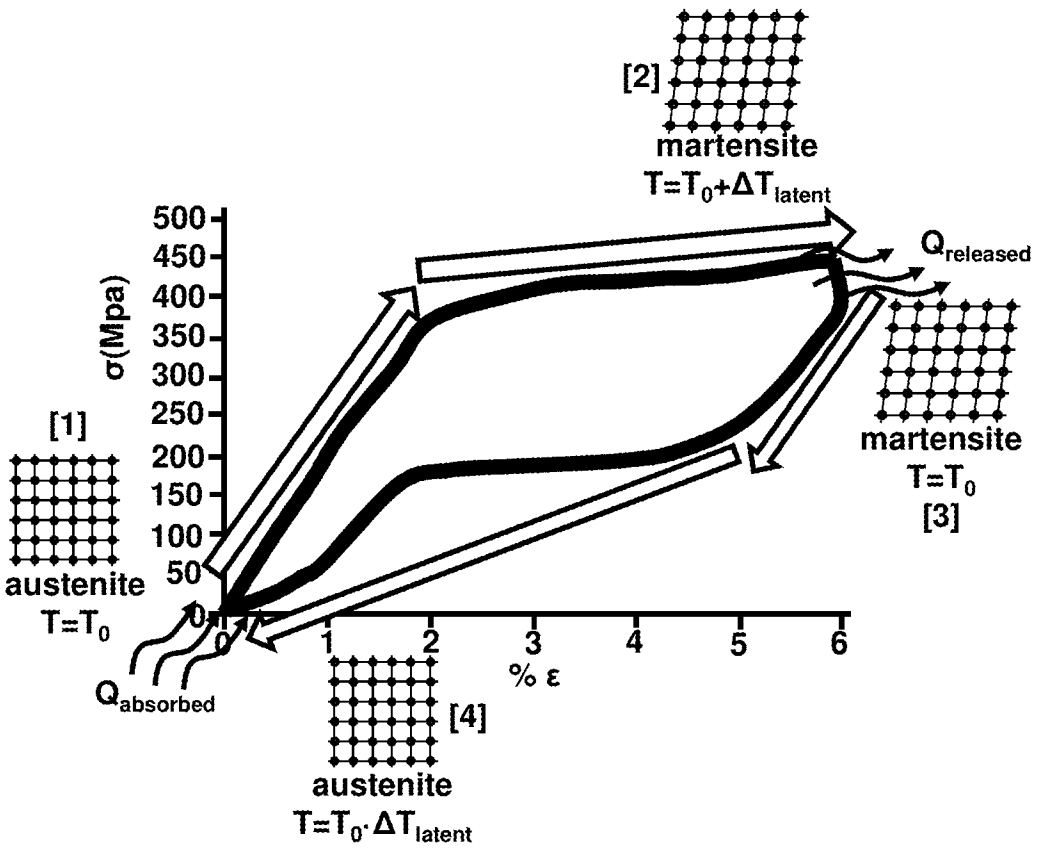
FIG. 2C is a graphical illustration of stress-strain characteristics and a thermodynamic process upon loading and unloading a nitinol sample, according to an embodiment herein.

A measured stress-strain relationship for NiTi at a strain rate of $10^{-4}$ $s^{-1}$ is shown in FIG. 2C. The arrows represent the 'direction' of the loading and unloading cycles and relative temperatures. As shown, the un-stressed material (state [1]) begins at room temperature in the austenite phase and, upon loading, begins to transition to the martensite phase at a critical strain of approximately 1-2%. Between the critical strain and the maximum value of 6%, the stress-strain exhibits a characteristic stress plateau, the exothermic austenite to martensite transformation occurs, and the NiTi alloy heats up (state [2]). Next, the released latent heat is dissipated to the environment, thus cooling the stressed martensite material (state [3]). Upon mechanical unloading, the stress-strain curve proceeds at a lower stress plateau than observed for the exothermic transformation, the endothermic reverse transformation occurs, and the NiTi alloy cools down below ambient temperature (state [4]). Finally, the absorbed latent heat is used to absorb energy from the environment, returning the temperature of the un-stressed material to room temperature (state [1]). High maximum strains (typically greater than 5-6%) can cause a permanent shift to the martensite phase, resulting in permanent mechanical deformation, and a reduction in observed latent heat. Therefore, care needs to be taken to avoid overloading the material.

The area inside the characteristic hysteresis curve in FIG. 2C is a result of irreversible losses in the material and represents the non-recoverable work required to drive the thermodynamic loop through one cycle. With knowledge of the latent heat, Equation (1), and the stress-strain (force-distance) hysteresis curve, the endothermic cooling COP can be calculated as provided by Equation (2):

$$COP_{cooling}=\frac{Q_{cool}}{W_{hysteresis}}=\frac{m_{NiTi}L_{endothermic}}{Fd} \quad (2)$$

where $Q_{cool}$ is the cooling work (J), $W_{hysteresis}$ is the cyclic work around stress-strain loop (J), m is the mass (g) of the sample undergoing phase transformation, $L_{endothermic}$ is the measured latent based on Equation (1), F is the applied force (N), and d is the distance (m) the force is applied.

As shown by Equation (2), elastocaloric cooling efficiency (COP) is strongly impacted by the material endothermic latent heat. The efficiency and temperature span are also strongly dependent on the maximum applied material strain and operating strain rate, whereby low strains typically decrease temperature span and increase efficiency and high strains increase temperature span and decrease efficiency. While latent heat is an intrinsic material property, controlling stress-strain parameters enables control of the phase transformation, mechanical stress-strain hysteretic response, temperature span, and resulting COP.

Both COP and total cooling power are important parameters to consider when designing an eC device. Considering the endothermic latent heat is an intrinsic value (J/g) and most sensible cooling architectures will have a fixed mass of NiTi material, a single cycle in FIG. 2C represents cooling potential (J) equivalent to the quotient of the latent heat and NiTi mass. Therefore, cycling the material through the loading-unloading loop at a higher frequency (and associated higher strain rate) is the only method to increase cooling power (J/s). So, despite the desire for high COP, some higher power applications inherently drive operation to high maximum strains (where full transformation occurs) and strain rates where cooling power is high, but COP is expected to decrease. This tradeoff is an additional consideration when developing elastocaloric cooling systems and establishes the need to test elastocaloric systems at low and high strain rates, alike.

EXPERIMENT

The specific parameters, values, amounts, ranges, materials, types, brands, etc. described below are approximates and were merely selected for the experiment, and as such the embodiments herein are not limited to the specific descriptions below. The samples tested are 1 mm diameter SMA 'NiTi #1-SE' wires available from Fort Wayne Metals (Indiana, USA). According to the manufacturer, these wires are primarily Nickel and Titanium (nominally $Ni_{56}Ti_{44}$ wt %) with less than 0.25 wt % of trace elements such as carbon, hydrogen, nitrogen, oxygen, cobalt, copper, chromium, iron, and niobium. The austenite finish ($A_f$) temperature is between 10 and 18° C., confirming the samples are elastocaloric at room temperature.

A FLIR® SC8300 infrared camera with a temperature resolution of 0.025K was used for the uniaxial tension and bending-mode testing while a FLIR® A40 infrared camera with a temperature sensitivity of 0.08K was used for the 'flow loop' testing. In all tests, the samples were coated with Sprayon® LU204 dry film graphite lubricant to provide high (approaching 1) and uniform emissivity.

Mechanical Characterization

An ADMET® single-column testing system was used to perform both uniaxial tension and four-point bending (flexural) testing. In both cases, custom fixtures were fabricated to allow interface with the standard pneumatic clamps. The ADMET® tensile tester was controlled in displacement mode (as opposed to force mode) to tightly control strain rate. During the loading and unloading cycle (between states [2] and [3] in FIG. 2C), the sample was held at a constant strain of ~6% for 60 s to allow the released latent heat to dissipate before the sample was unloaded.

The uniaxial tension fixture was a 'caul plate and loop' design, created to provide sufficient surface area contact (friction) between the fixture and NiTi material to prevent slipping during loading. Stress was calculated according to Equation (3):

$$\sigma=\frac{F}{A} \quad (3)$$

where σ is stress (Pa), F is the measured force (N), and A is the cross-sectional area ($m^2$) of the sample (e.g., NiTi material). The strain rate ($s^{-1}$) during uniaxial testing was calculated according to Equation (4):

$$\frac{\varepsilon}{\Delta t} = \frac{\Delta L / L}{\Delta t} \tag{4}$$

where ε is the strain, Δt is the time (seconds) it took to move from 0% to the maximum strain, L is the original length (m) of the unloaded NiTi sample, and ΔL is the change in length (m) of the sample.

In four-point bending, the maximum flexural stress and strain is spread over the section of the NiTi sample between the top loading points of the sample. This provides, in the experimental setup, ~6 mm of NiTi material that is loaded at the same stress and strain. Additionally, the majority of the actively strained area is not in contact with the anvil, so less thermal interaction between the fixture and sample is expected, thus providing a more-adiabatic condition. To further prevent parasitic heat loss, the fixtures were constructed out of polycarbonate with a low bulk thermal conductivity value of 0.19-0.22 W/mK. Conversely, in the case of three-point bending the maximum stress would be isolated in a smaller volume directly under the loading anvil, making thermal imaging difficult and facilitating parasitic heat loss.

An optical method was used to approximate the required deflection necessary to provide a maximum of 6% strain. To accomplish this, the sample was mechanically loaded until the observed curvature matched the contour of a circle with a known radius. This is calculated using the following Equation (5):

$$\varepsilon = \frac{y}{R} \tag{5}$$

where y is the distance (m) from the neutral axis (in the case of maximum strain, this is the radius of the sample), and R is the radius of curvature (m).

This method is wholly sufficient for materials with symmetric compression and tension responses (as is the case with most elastic materials), however, NiTi exhibits an asymmetric response which can be expected to shift the neutral axis. Knowing the required deflection for an approximate strain of 6%, the 'displacement rate' was set accordingly to provide the desired strain rate. However, due to the above complications with calculating the exact strain, and further uncertainty in the instantaneous elastic modulus, stress during bending could not be reliably reported. Instead, uniaxial tension and bending-mode results will be compared in axes of force vs. strain in the results and discussion section. As shown in Equations (1) and (2) the only parameters required to calculate $Q_{cool}$, $W_{hysteresis}$, and $COP_{cooling}$, are force, distance, area, $\Delta T_{endothermic}$, and $C_{p\ NiTi}$, are all of which are intrinsic properties or directly measured.

Continuous Flow eC 'Loop'

Figure 3:
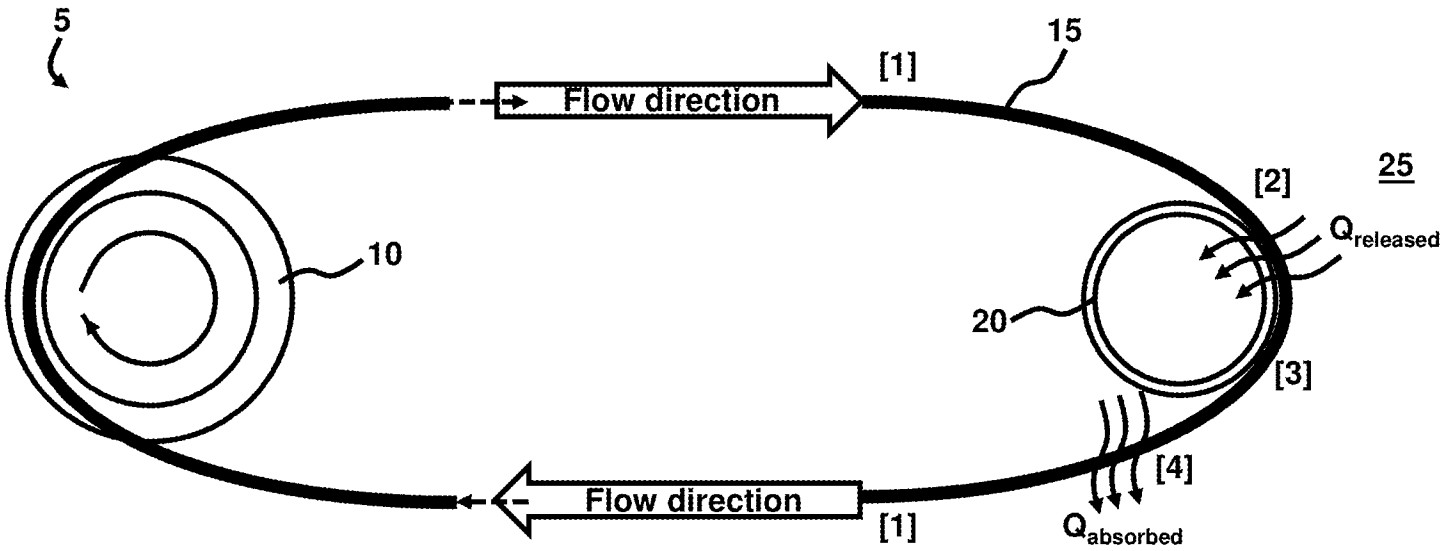
FIG. 3 is a schematic diagram illustrating an elastocaloric cooling system (i.e., a heat transfer system), according to an embodiment herein.

FIG. 3 is a schematic diagram of the elastocaloric cooling system (i.e., a heat transfer system) 5 used in accordance with the embodiments herein. Generally, the continuous elastocaloric cooling 'flow loop' comprises a mechanism such as a stepper motor 10 to 'pump' the elastocaloric material 15, a 18 mm-diameter copper tube heat exchanger 20 (to provide the required strain of ~6%) and dissipate the exothermic latent heat, and an assortment of mechanical and fluidic connections (not shown).

More specifically, the elastocaloric cooling system 5 comprises an elastocaloric material 15 such as any of nitinol-based, copper-based, polymer-based, and magnetic shape memory materials, for example. The elastocaloric material 15 may also be referred to as a thermoelastic material. The elastocaloric material 15 may be configured as a wire, in an example. The heat exchanger 20 comprises defined radius of curvature and is provided along with the motor 10 to drive the elastocaloric material 15 around the heat exchanger 20 causing continuous bending of the elastocaloric material 15 according to the defined radius of curvature for a predetermined period of time creating a first phase transformation in the elastocaloric material 15. According to some examples, the defined radius of curvature could be a defined 'fixed radius of curvature' such as a circle, or a 'spatially varying radius of curvature' such as an ellipsoid. In an example, the predetermined period of time may comprise approximately 60 seconds. However, other durations may be utilized in accordance with the embodiments herein. According to some examples, the bending may comprise three-point bending, four-point bending, buckling, edge-bending, and v-bending, among others.

The heat exchanger 20 is to transfer exothermic latent heat ($Q_{absorbed}$) emitted from the elastocaloric material 15 due to the first phase transformation during the predetermined period of time. Moreover, the heat exchanger 20 is to transfer endothermic latent heat ($Q_{released}$) from an ambient environment 25 adjacent to the elastocaloric material 15 after the predetermined period of time ends and the elastocaloric material 15 is no longer experiencing bending. The endothermic latent heat transfer ($Q_{released}$) may cause a temperature decrease of the elastocaloric material 15. For example, the temperature decrease may be in a range of 1.85° C. to 16° C. Additionally, the elastocaloric material 15 may undergo a second phase transformation when the elastocaloric material 15 is no longer experiencing bending.

The motor 10 is provided to generate a stress on the elastocaloric material 15 to cause a continuous bending of the elastocaloric material 15 for a predetermined period of time (i.e., approximately 60 seconds, for example) to create a solid-to-solid phase transformation in the elastocaloric material 15. A first phase transformation causes exothermic heat transfer ($Q_{absorbed}$) from the elastocaloric material 15 while stress is generated, and a second phase transformation causes endothermic heat transfer ($Q_{released}$) to the elastocaloric material 15 after the stress is decreased.

The elastocaloric material 15 may comprise elastocaloric crystals that undergo an austenite crystal to martensite crystal transformation during the first phase transformation. Furthermore, the elastocaloric material 15 may comprise elastocaloric crystals that undergo a martensite crystal to austenite crystal transformation during the second phase transformation. The first phase transformation may comprise a first strain rate, and the second phase transformation may comprise a second strain rate. According to an example, the first strain rate may be symmetric to the second strain rate.

The un-stressed (un-bent) material (FIG. 2C, state [1]) begins at room temperature in the austenite phase. Upon loading to a maximum value of ~6%, the exothermic austenite to martensite transformation occurs and the NiTi alloy heats up (FIG. 2C, state [2]). Next, the released latent heat is dissipated to the copper tube heat exchanger 20, thus cooling the stressed martensite material (FIG. 2C, state [3]). Upon mechanical unloading, the endothermic reverse transformation occurs, and the NiTi alloy cools down below ambient temperature (FIG. 2C, state [4]). Finally, the absorbed latent heat is used to absorb energy from the environment, returning the temperature of the un-stressed material to room temperature (FIG. 2C, state [1]). In this way, a continuous elastocaloric cooling 'flow loop' is achieved.

Determination of Strain Rate and Cooling Power

Figure 4:
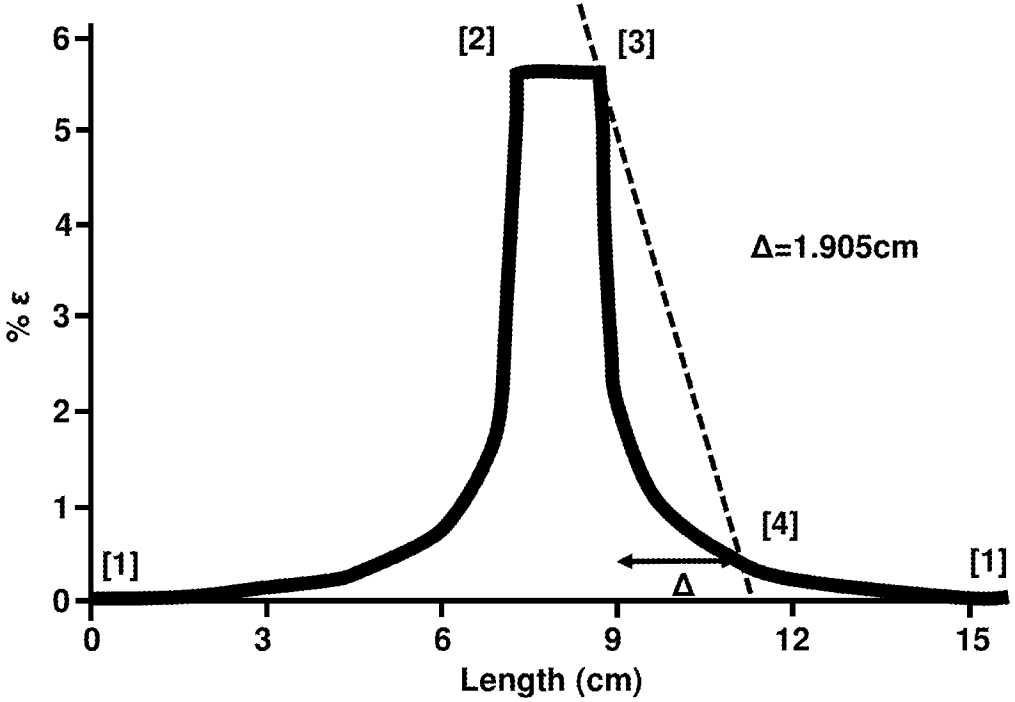
FIG. 4 is a graphical illustration of calculated strain along the length of a wire, according to an embodiment herein.

An optical method and accompanying MATLAB script was developed to calculate the curvature and approximate strain at different locations throughout the loop. FIG. 4 shows calculated strain vs. length along the sample. At a length of approximately 7.3 cm from the copper tube, the strain is 0%. From a length of 0 to 7.3 cm, the strain increases before reaching the maximum strain of 5.59%. Between 7.3 cm and 8.7 cm, the wire follows the curvature of the tube and maintains a strain of 5.59%. The unloading strain is symmetric to the loading strain. It was observed experimentally that the majority of the endothermic heat transfer occurred between the maximum strain and approximately 0.5%. The length of wire between these two distinct strains (as shown by the dashed line on FIG. 4) was 1.905 cm. Therefore, during the endothermic unloading phase (states [3] to [4]) the strain per cm of wire travel is 2.67% $cm^{-1}$. During testing, the feed rate (f) of the stepper motor (cm/s) was adjusted to yield the desired strain rates between 0.001 and 0.025 $s^{-1}$.

With knowledge of the effective endothermic latent heat of the material ($L_{endothermic}$), the feed rate (f), density ρ, and wire radius (r), the theoretical cooling power (W) during operation was calculated using the following Equation (6):

$$\text{Power}_{theoretical}=\pi r^2 f \rho L_{endothermic} \tag{6}$$

The experimental cooling power (W) was determined by placing a copper block with an embedded thermocouple in dry contact at state [4] on the 'flow loop'. From the time dependent temperature change, mass and specific heat of the copper block, the experimental cooling power could be determined by Equation (7):

$$Power_{exp.} = \frac{\Delta T_{copper}}{\Delta t} \times C_{p\ copper} \times m_{copper} \tag{7}$$

where $\Delta T_{copper}$ is the temperature change of the copper (K or ° C.), Δt is the time (seconds), and $C_{p\ copper}$ is the specific heat of copper (0.385 J/g-K), and $m_{copper}$ is the mass of the copper sample (19.2 g).

Results

The NiTi elastocaloric material was tested using the aforementioned test setups under uniaxial tension, bending, and in the newly configured elastocaloric 'flow loop' orientations with strain rates of 0.001, 0.0025, 0.01, and 0.025 $s^{-1}$ and a strain of ~6%. The experimental data under different strain modes are compared and contrasted in context of competing cooling technologies in the following sections.

Uniaxial and Bending-Mode Results

Figure 5:
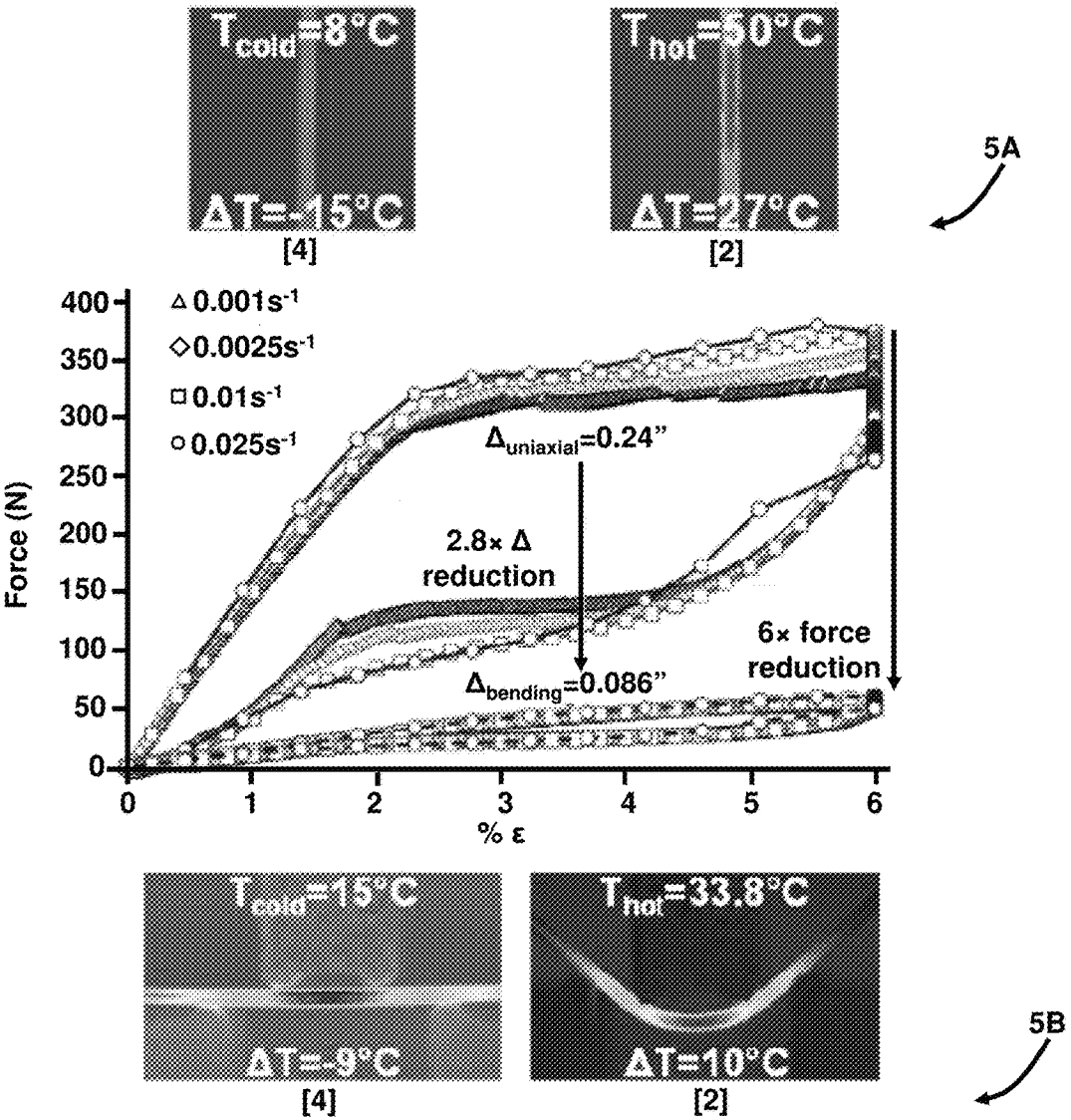
FIG. 5 is a graphical illustration of force vs. strain results for the uniaxial tension and bending-mode tests with a maximum strain of 6% and strain rates ranging from 0.001 to 0.025 $s^{-1}$, with representative infrared images for states [2] and [4], after the uniaxial and bending-mode tests with the maximum strain rate of 0.025 $s^{-1}$, respectively, according to an embodiment herein.

FIG. 5 shows the force vs. strain results for the uniaxial tension and bending-mode tests. Infrared images at the end of the exothermic (state [2]) and endothermic (state [4]) phase transformations for the tension and bending tests are shown in 5A and 5B, respectively. Uniaxial tests required much higher force to reach 6% strain than their four-point bending counterparts. As shown, bending allowed a 6× reduction in force and a 2× reduction in actuation distance. As shown in FIG. 5, this comes at the expense of reduced endothermic temperature change. Physically this occurs because in uniaxial testing, all of the sample is being stressed and experiences the same strain, while in bending the material closest to the neutral axis is experiencing minimal stress and strain, therefore the phase transformation is not occurring throughout.

Figure 6:
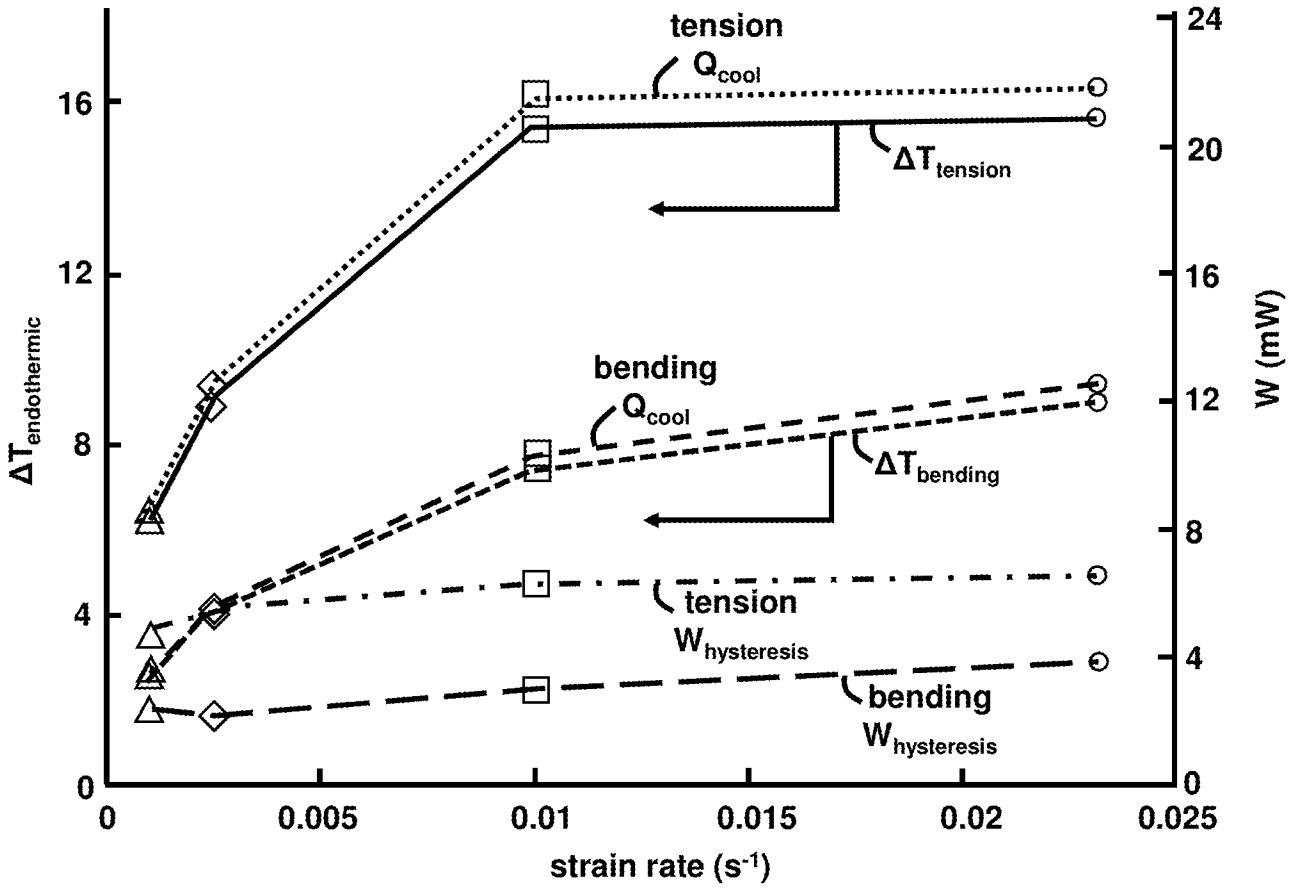
FIG. 6 is a graphical illustration of the strain rate dependency of the endothermic temperature change, calculate $W_{cooling}$, and $W_{hysteresis}$, according to an embodiment herein.

FIG. 6 shows the relationships between the endothermic temperature change, calculated $W_{cooling}$, and $W_{hysteresis}$ and the applied strain rate. As the strain rate increases, the temperature change increases for both the uniaxial tension and bending cases. The maximum temperature drop observed was 8.95° C. and 15.67° C. for the bending and tension cases, respectively. The data points labeled 'uniaxial' and 'bending' are shown in FIG. 6. The cooling work ($Q_{cool}$) increased with strain rate and temperature rise as per Equations (1) and (2). The area inside the hysteresis curves (FIG. 5) increased as the strain rate increased, resulting in increasing mechanical work ($W_{hysteresis}$). However, the measured $Q_{cool}$ values were always larger than the $W_{hysteresis}$ values.

Figure 7:
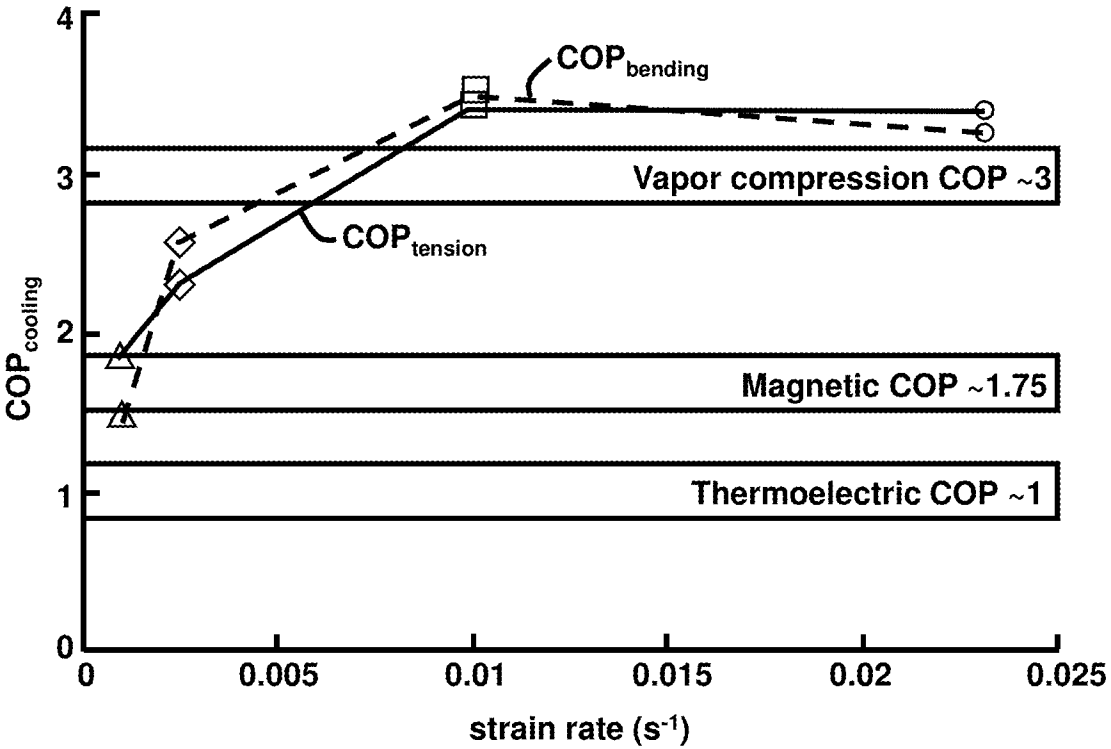
FIG. 7 is a graphical illustration of the strain rate dependency of the $COP_{cooling}$, according to an embodiment herein.

As shown in FIG. 7, the reported COP values for tensile and bending testing are comparable. For both cases, COP increased drastically from ~1.5 at the lowest strain rate to a maximum value of 3.5 at a strain rate of 0.01 $s^{-1}$. As shown on FIG. 6, this is a result of rapidly increasing $\Delta T_{endothermic}$ values, and corresponding $Q_{cooling}$ values, and a smaller increase in the $W_{hysteresis}$ values. At the highest strain rate, 0.025 $s^{-1}$, the reported COP slightly dropped to a value of 3.25. This saturation effect and apparent plateau in the endothermic temperature change corresponds with the adiabatic limit. At this adiabatic limit, the latent heat of the material during uniaxial tension was calculated to be 7.52 J/g using Equation (1). To properly calculate the latent heat for bending, a better understanding of the stress-strain gradient and mass of activated material would need to be known, but an effective value of 4.11 J/g was calculated using the entire mass between the top loading points. A summary of these results for the performance characteristics of the uniaxial tension and bending-mode elastocaloric experiments for one thermodynamic cycle are provided in Table 1.

TABLE 1

Performance Characteristics of Uniaxial tension and Bending-mode

| | Uniaxial tension | | | | Bending-mode | | | |
|---|---|---|---|---|---|---|---|---|
| | 0.001 $s^{-1}$ | 0.0025 $s^{-1}$ | 0.01 $s^{-1}$ | 0.025 $s^{-1}$ | 0.001 $s^{-1}$ | 0.0025 $s^{-1}$ | 0.01 $s^{-1}$ | 0.025 $s^{-1}$ |
| $\Delta T_{exo}$ (K) | 10.22 | 12.43 | 18.46 | 27.12 | 2.19 | 4.46 | 8.63 | 9.66 |
| $\Delta T_{endo}$ (K) | −6.19 | −8.91 | −15.39 | −15.67 | −2.55 | −3.95 | −7.39 | −8.95 |
| $Q_{cool}$ (mW) | 8.66 | 12.45 | 21.52 | 21.91 | 3.56 | 5.52 | 10.33 | 12.51 |
| $W_{hysteresis}$ (mW) | 4.71 | 5.41 | 6.26 | 6.52 | 2.38 | 2.14 | 2.94 | 3.83 |
| $COP_{cooling}$ | 1.84 | 2.29 | 3.43 | 3.35 | 1.49 | 2.58 | 3.51 | 3.26 |

where $\Delta T_{exo}$ denotes $\Delta T_{exothermic}$ and $\Delta T_{endo}$ denotes $\Delta T_{endothermic}$.

Typical values of COP for vapor compression (COP~3), magnetocaloric (COP~1.75), and thermoelectric (COP~1) are represented by the rectangular bands on FIG. 7. For all strain rates tested, the calculated elastocaloric COP values were higher than those expected for thermoelectrics, and greater than or equal to reported values for magnetocaloric cooling. Vapor compression had higher COPs at low strain rates where endothermic temperature changes were low in the NiTi samples, and comparable (but slightly lower) COPs at strain rates between 0.01 and 0.025 $s^{-1}$.

Continuous Flow 'Loop' Results

Figure 8:
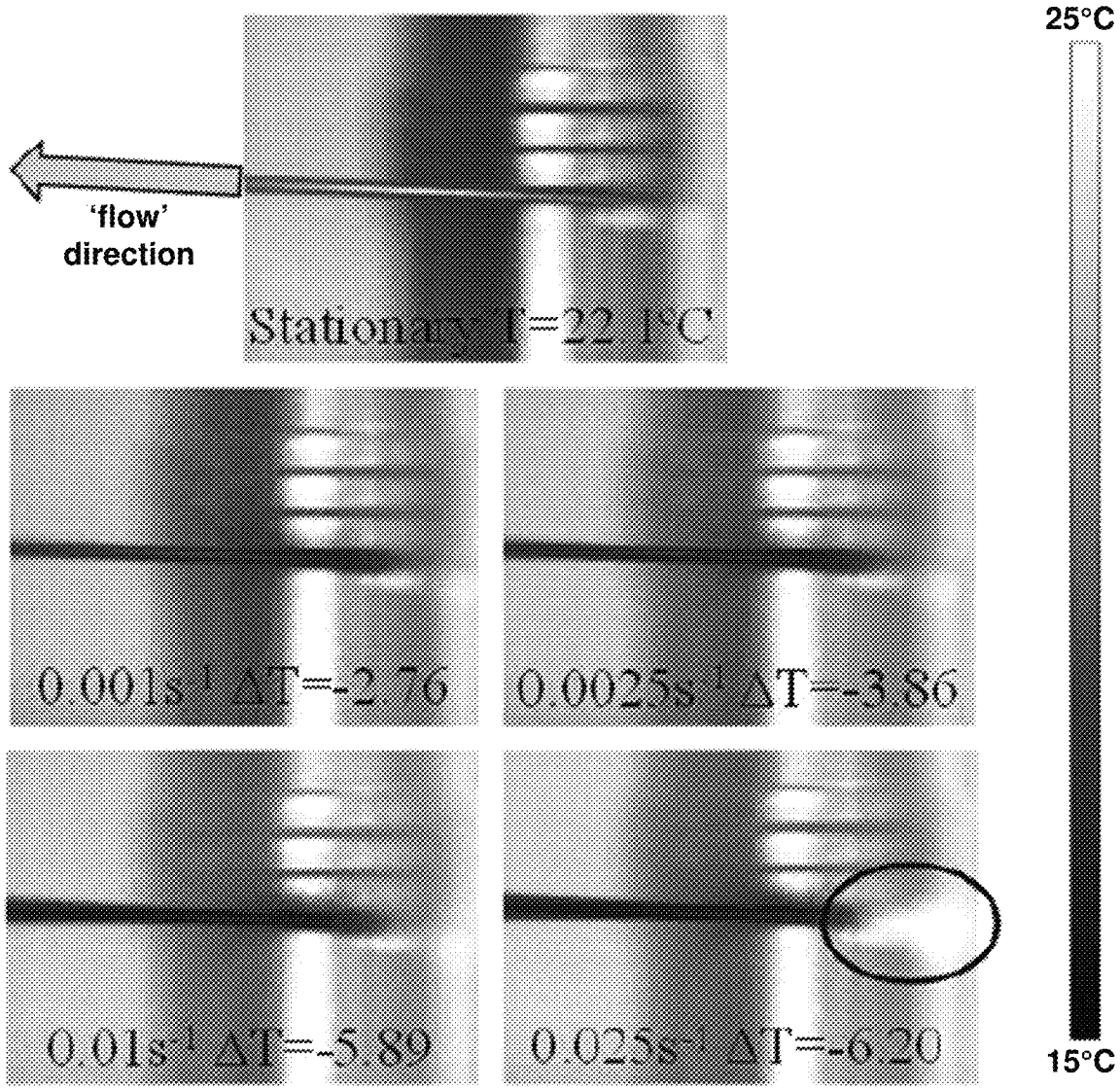
FIG. 8 are infrared images of state [4] after unloading during an elastocaloric flow loop test for a stationary sample and strain rates ranging from 0.001 to 0.025 $s^{-1}$, according to an embodiment herein.

Elastocaloric flow 'loop' experiments were performed using the test setup described in FIG. 3. FIG. 8 shows infrared photographs of state [4] (after unloading) during elastocaloric 'flow loop' testing for a benchmark stationary sample and strain rates ranging from 0.001 to 0.025 $s^{-1}$. The temperature range (15-25° C.) was kept constant for all images shown. The observed $\Delta T_{endothermic}$ values increased from −2.76 to −6.20 as the strain rate increased from the minimum strain rate of 0.001 $s^{-1}$ to the maximum value of 0.025 $s^{-1}$. For low strain rates (<0.0025 $s^{-1}$), the 'flow loop' temperature drop values were within a few tenths of a degree to the bending-mode results summarized in Table 1 and FIG. 6. However, at larger strain rates, the temperature drop began to deviate from the bending-mode results. Specifically, at a strain rate of 0.01 $s^{-1}$ the 'flow loop' temperature change was 1.5° C. less than the bending-mode. For the maximum strain rate of 0.025 $s^{-1}$, the flow 'loop' temperature change was 2.75° C. less than the bending-mode.

This deviation is believed to be the result of two possible effects: frictional heating and poor thermal exchange between the NiTi sample and copper tube heat exchanger. As mentioned previously, during the uniaxial and bending mode tests the sample was allowed to return to room temperature (60 s dwell time) before unloading occurred. However, in the flow 'loop' orientation the dwell time was feed rate dependent and varied from 19s for the smallest strain rate to 1.4 s for the highest strain rate. It is believed that the exothermic latent heat was not removed from the sample before unloading occurred, thus reducing the observed temperature drop. This effect, along with possible frictional heating, is apparent in FIG. 8 at the maximum strain rate of 0.025 $s^{-1}$ where the sample appears to be warmer than ambient.

Figure 9:
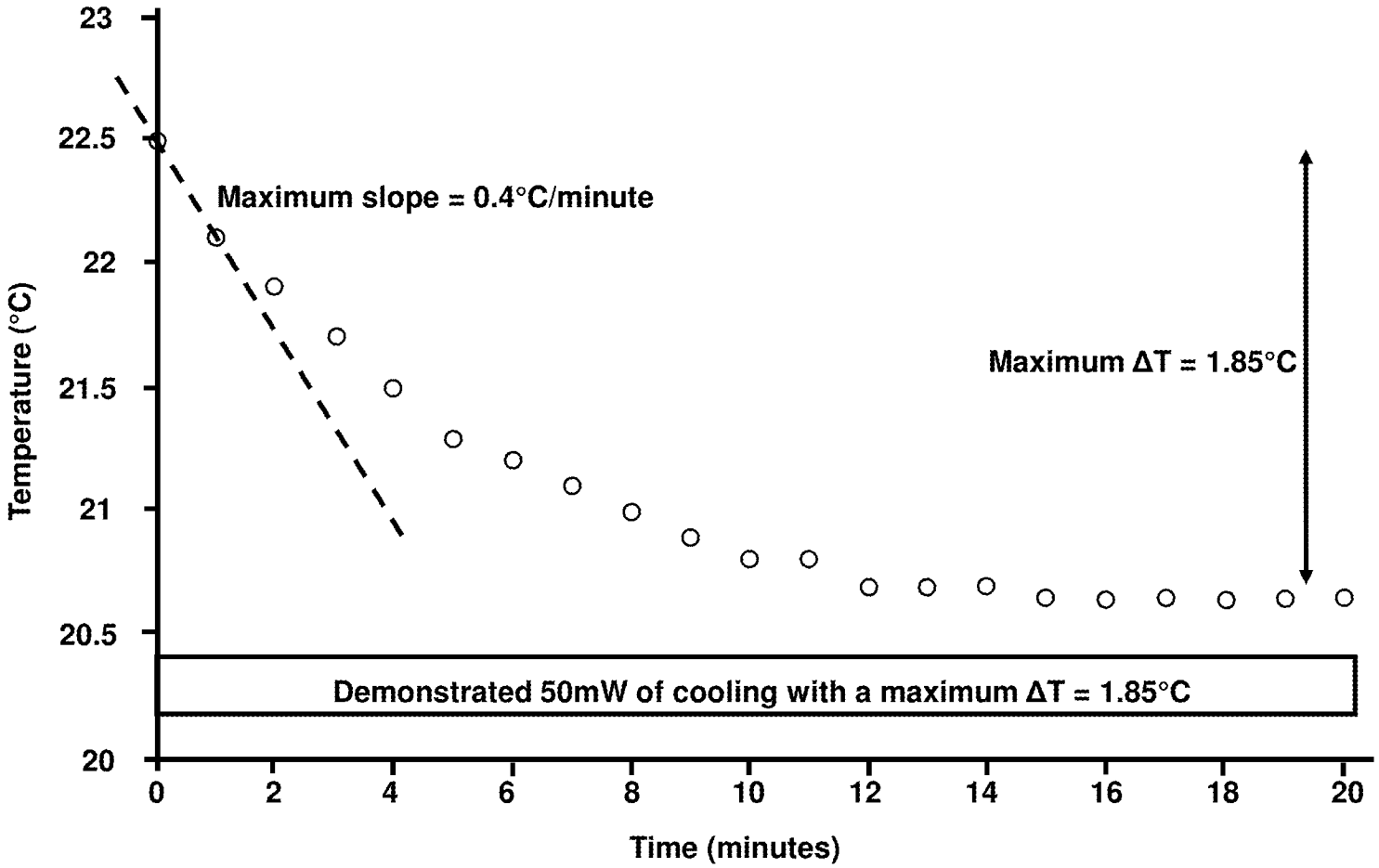
FIG. 9 is a graphical illustration of the temperature evolution of a copper block at a maximum strain rate of 0.025 $s^{-1}$, according to an embodiment herein.

Theoretical 'flow loop' cooling values, based on Equation (6), ranged from 15 mW to 210 mW across the range of strain rates tested, with higher rates resulting in higher cooling powers. FIG. 9 shows the temperature evolution of the thermocouple embedded copper sample used to experimentally determine cooling power. The maximum temperature drop after 20 minutes of operation was 1.85° C., despite an observed adiabatic temperature drop of 6.20° C. in FIG. 8. Based on the observed maximum slope of 0.4° C./minute (0.007° C./s) in FIG. 9, the experimental cooling power (Equation (7)) was calculated to be 50 mW (expected 210 mW). Deviation from theoretical and adiabatic results is presumably a combined effect of parasitic heat loss in the copper sample, poor thermal contact (dry contact) between the NiTI and copper, and friction.

The embodiments herein provide a continuous 'loop' architecture for an eC cooler, which maintains the COP of uniaxial stress while taking advantage of nearly ubiquitous rotational motion actuators. Experimental bending (flexural) tests demonstrated material COPs as high as 3.5 and endothermic temperature drops as high as 8.95° C. for strain rates ranging from 0.01 and 0.025 $s^{-1}$. These bending-mode tests provide reduced actuation force and distance compared to more-traditional uniaxial tension tests. The elastocaloric 'flow loop' demonstrated a maximum 50 mW of cooling power with a 1.85° C. sub-ambient temperature drop.

Liquid-Vapor phase change (i.e., vapor compression) has been used for close to a decade for everything from food refrigeration, space heating/cooling, vehicle cabin cooling, electronic cooling, cryogenic cooling, microclimate cooling units, etc. The embodiments herein could be used to replace these standard vapor compression heating/cooling systems.

The foregoing description of the specific embodiments will so fully reveal the general nature of the embodiments herein that others may, by applying current knowledge, readily modify and/or adapt for various applications such specific embodiments without departing from the generic concept, and, therefore, such adaptations and modifications should and are intended to be comprehended within the meaning and range of equivalents of the disclosed embodiments. It is to be understood that the phraseology or terminology employed herein is for the purpose of description and not of limitation. Therefore, while the embodiments herein have been described in terms of preferred embodiments, those skilled in the art will recognize that the embodiments herein may be practiced with modification within the spirit and scope of the appended claims.

What is claimed is:

1. A method of cooling comprising:

providing an elastocaloric material;

continuously applying a force on the elastocaloric material to cause a continuous mechanical deformation of the elastocaloric material for a predetermined period of time, wherein the continuous mechanical deformation creates a solid-to-solid phase transformation in the elastocaloric material;

emitting exothermic latent heat from the elastocaloric material to increase a temperature of the elastocaloric material;

removing the force from the elastocaloric material upon expiration of the predetermined period of time; and absorbing endothermic latent heat into the elastocaloric material to decrease the temperature of the elastocaloric material.

2. The method of claim 1, wherein the solid-to-solid phase transformation in the elastocaloric material comprises a first-order austenite crystal to martensite crystal phase transformation.

3. The method of claim 1, wherein the absorbing of the endothermic heat into the elastocaloric material may decrease the temperature of an environment adjacent to the elastocaloric material.

4. The method of claim 1, wherein the mechanical deformation comprises bending.

5. The method of claim 1, wherein the mechanical deformation comprises a continuous loop or flow loop.

6. The method of claim 1, comprising causing the continuous mechanical deformation to occur until reaching a mechanical strain of approximately 6% for the elastocaloric material.

7. The method of claim 1, wherein the absorbing of the endothermic latent heat into the elastocaloric material decreases the temperature of the elastocaloric material to below a temperature of an adjacent ambient environment of the elastocaloric material.

8. The method of claim 7, wherein the temperature of the elastocaloric material decreases by at least 1.85° C. compared with the adjacent ambient environment.

9. An elastocaloric cooling system comprising:

an elastocaloric material;

a heat exchanger comprising a defined radius of curvature; and a motor to drive the elastocaloric material around the heat exchanger causing continuous bending of the elastocaloric material according to the defined radius of curvature for a predetermined period of time creating a first phase transformation in the elastocaloric material, wherein the heat exchanger is to transfer exothermic latent heat emitted from the elastocaloric material due to the first phase transformation during the predetermined period of time, and wherein the heat exchanger is to transfer endothermic latent heat from an ambient environment adjacent to the elastocaloric material after the predetermined period of time ends and the elastocaloric material is no longer experiencing bending.

10. The elastocaloric cooling system of claim 9, wherein the elastocaloric material comprises any of nitinol-based, copper-based, polymer-based, and magnetic shape memory materials.

11. The elastocaloric cooling system of claim 9, wherein the endothermic latent heat transfer causes a temperature decrease of the elastocaloric material.

12. The elastocaloric cooling system of claim 11, wherein the temperature decrease is in a range of 1.85° C. to 16° C.

13. The elastocaloric cooling system of claim 9, wherein the elastocaloric material undergoes a second phase transformation when the elastocaloric material is no longer experiencing bending.

14. The elastocaloric cooling system of claim 9, wherein the bending comprises three-point bending, four-point bending, buckling, edge-bending, or v-bending.

15. The elastocaloric cooling system of claim 9, wherein the predetermined period of time comprises approximately 60 seconds.

16. A heat-exchanger system comprising:

a thermoelastic material; and a mechanism to generate a stress on the thermoelastic material to cause a continuous bending of the thermoelastic material for a predetermined period of time to create a solid-to-solid phase transformation in the thermoelastic material, wherein a first phase transformation causes exothermic heat transfer from the thermoelastic material while stress is generated, and wherein a second phase transformation causes endothermic heat transfer to the thermoelastic material after the stress is decreased.

17. The heat-exchanger system of claim 16, wherein the thermoelastic material comprises elastocaloric crystals that undergo an austenite crystal to martensite crystal transformation during the first phase transformation.

18. The heat-exchanger of claim 16, wherein the thermoelastic material comprises elastocaloric crystals that undergo a martensite crystal to austenite crystal transformation during the second phase transformation.

19. The heat-exchanger system of claim 16, wherein the mechanism comprises a stepper motor.

20. The heat-exchanger system of claim 16, wherein the first phase transformation comprises a first strain rate, wherein the second phase transformation comprises a second strain rate, and wherein the first strain rate is symmetric to the second strain rate.

21. The method of claim 1, wherein the force on the elastocaloric material is applied by a motor.

22. The elastocaloric cooling system of claim 9, wherein the elastocaloric material bends only around one heat exchanger having the defined radius of curvature.

23. The elastocaloric cooling system of claim 9, wherein the bending occurs about a neutral axis of the elastocaloric material with the elastocaloric material is in tension on one side of the neutral axis and is in compression on the other side of the neutral axis.

24. The elastocaloric cooling system of claim 23, wherein the neutral axis of the elastocaloric material is substantially parallel to the direction it is driven.

25. The elastocaloric cooling system of claim 9, wherein the motor drives the elastocaloric material to bend, at least partially, around an outer periphery of the heat exchanger having the defined radius of curvature.

* * * * *